US010846948B2

(12) United States Patent
Stacy

(10) Patent No.: US 10,846,948 B2
(45) Date of Patent: Nov. 24, 2020

(54) DRIVING BEHAVIOR MONITORING SYSTEM

(71) Applicant: WUNELLI LIMITED, Portsmouth (GB)

(72) Inventor: Paul Rowan Stacy, Petersfield (GB)

(73) Assignee: Wunelli Limited, Portsmouth (GB)

( * ) Notice: Subject to any disclaimer, the term of this patent is extended or adjusted under 35 U.S.C. 154(b) by 0 days.

(21) Appl. No.: 15/864,214

(22) Filed: Jan. 8, 2018

(65) Prior Publication Data

US 2018/0130268 A1 May 10, 2018

Related U.S. Application Data

(63) Continuation of application No. 14/417,282, filed as application No. PCT/GB2013/052021 on Jul. 26, 2013, now Pat. No. 9,905,057.

(30) Foreign Application Priority Data

Jul. 26, 2012 (GB) ..... 1213291.6

(51) Int. Cl.
*G07C 5/00* (2006.01)
*G07C 5/08* (2006.01)

(52) U.S. Cl.
CPC ..... *G07C 5/008* (2013.01); *G07C 5/08* (2013.01)

(58) Field of Classification Search
USPC ..... 701/31.5
See application file for complete search history.

(56) References Cited

U.S. PATENT DOCUMENTS 4,695,946 A * 9/1987 Andreasen ..... G06F 11/00 714/31
5,926,142 A 7/1999 Rathgeb et al.
(Continued)

FOREIGN PATENT DOCUMENTS

| | | | |
|---|---|---|---|
| EP | 1811481 | A1 | 7/2007 |
| GB | 2470147 | A | 11/2010 |
| WO | 2008107514 | A1 | 9/2008 |

OTHER PUBLICATIONS

English Translation for Chinese Patent Application Pub. No. CN101142397B (downloaded Aug. 8, 2019).*
(Continued)

*Primary Examiner* — Jean Paul Cass
(74) *Attorney, Agent, or Firm* — Troutman Pepper Hamilton Sanders LLP; James E. Schutz; Mark Lehi Jones

(57) ABSTRACT

A driving behavior monitoring system (11) comprising an on-board diagnostic module (3) adapted to be mounted in a vehicle, the on-board diagnostics module comprising a vehicle usage monitor operative to monitor usage of the vehicle and to generate vehicle usage data based on at least one usage characteristic of the vehicle, the system further comprising a controller (5) and a driving behavior scoring server (9) arranged to be in real-time communication with the controller via a telecommunications network, the on-board diagnostic module further comprising a transceiver operative to transmit the vehicle usage data to the server via the controller, the server comprising a database (12) on which vehicle usage data is stored, the server further comprising a data processor operative to generate a driving behavior score by processing the vehicle usage data generated by the on-board diagnostic module and the road usage data stored on the database.

20 Claims, 2 Drawing Sheets

(56) References Cited

U.S. PATENT DOCUMENTS

Figure 1:
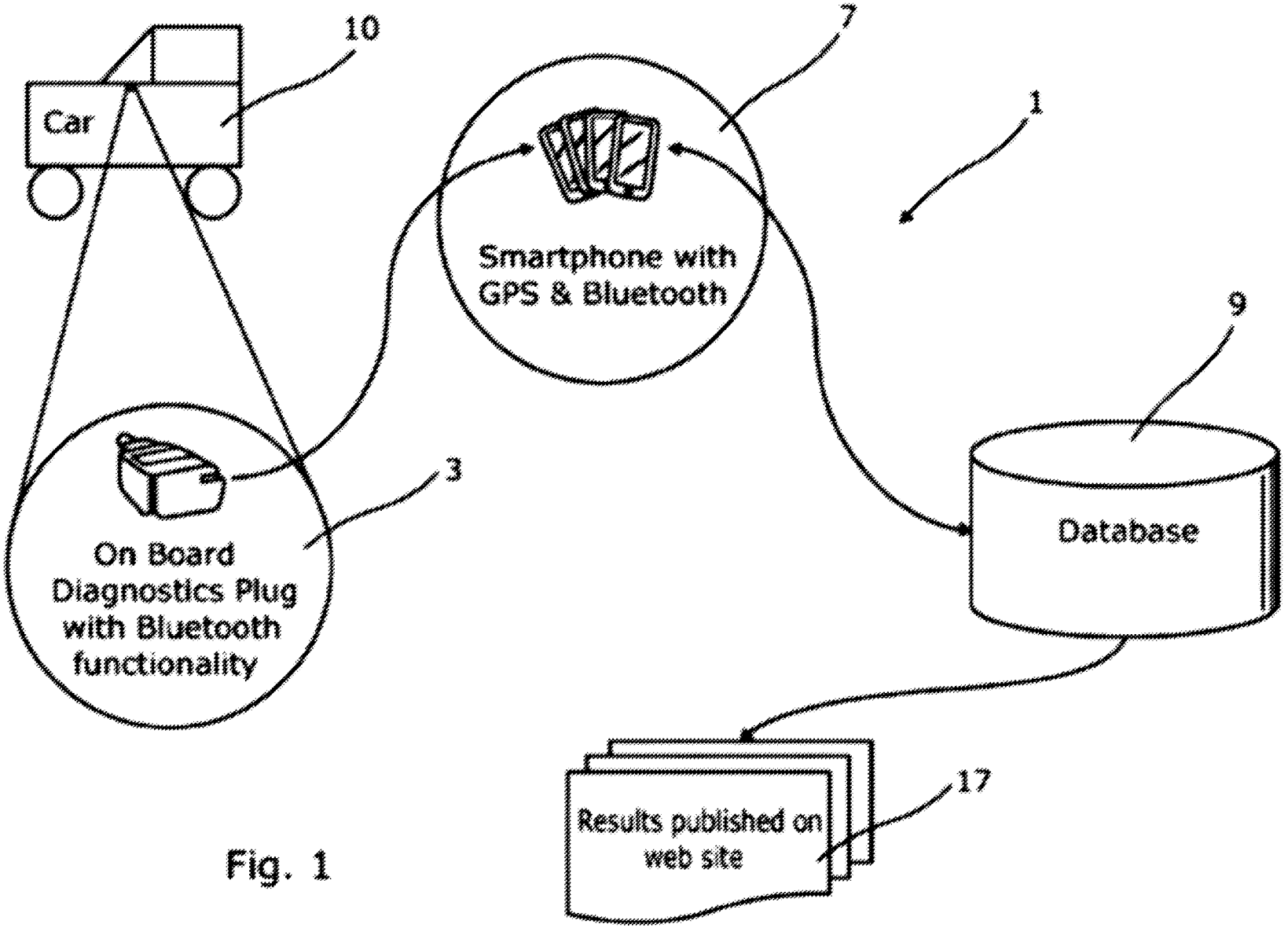

| | | | | |
|---|---|---|---|---|
| 7,937,075 | B2 * | 5/2011 | Zellner | H04L 67/12 455/418 |
| 8,897,952 | B1 * | 11/2014 | Palmer | H04L 67/12 701/31.5 |
| 9,171,458 | B2 * | 10/2015 | Salter | G01D 4/002 |
| 9,196,098 | B2 | 11/2015 | Phelan et al. | |
| 9,275,552 | B1 * | 3/2016 | Fields | G01C 21/3676 |
| 9,783,159 | B1 * | 10/2017 | Potter | G08B 25/00 |
| 9,805,601 | B1 * | 10/2017 | Fields | G08G 1/096844 |
| 9,908,530 | B1 * | 3/2018 | Fields | B60K 28/066 |
| 9,934,667 | B1 * | 4/2018 | Fields | G08B 21/02 |
| 9,940,834 | B1 * | 4/2018 | Konrardy | G08G 1/161 |
| 9,972,054 | B1 * | 5/2018 | Konrardy | G06Q 40/00 |
| 10,118,487 | B1 * | 11/2018 | Riley, Sr. | A61B 5/6802 |
| 10,134,278 | B1 * | 11/2018 | Konrardy | G08G 1/096791 |
| 2002/0188392 | A1 | 12/2002 | Breed et al. | |
| 2004/0215382 | A1 | 10/2004 | Breed et al. | |
| 2007/0001831 | A1 | 1/2007 | Raj et al. | |
| 2007/0027583 | A1 | 2/2007 | Tamir et al. | |
| 2007/0073482 | A1 * | 3/2007 | Churchill | G01C 21/165 701/492 |
| 2008/0294690 | A1 | 11/2008 | McClellan | |
| 2010/0036564 | A1 | 2/2010 | Blaise et al. | |
| 2010/0207787 | A1 | 8/2010 | Catten | |
| 2011/0012720 | A1 | 1/2011 | Hirschfeld | |
| 2011/0077028 | A1 | 3/2011 | Wilkes, III | |
| 2011/0112717 | A1 | 5/2011 | Resner | |
| 2011/0251752 | A1 | 10/2011 | DeLarocheliere et al. | |
| 2011/0313593 | A1 | 12/2011 | Cohen et al. | |
| 2012/0089423 | A1 | 4/2012 | Tamir | |
| 2013/0006674 | A1 * | 1/2013 | Bowne | H04W 4/40 705/4 |
| 2013/0176176 | A1 | 7/2013 | Vos et al. | |
| 2013/0265178 | A1 * | 10/2013 | Tengler | G08G 1/091 340/989 |
| 2014/0240132 | A1 * | 8/2014 | Bychkov | A61B 5/18 340/576 |

OTHER PUBLICATIONS

NPL, Mahaffey, Kevin et al., Fuzzit: A Mobile Fuzzing Tool, (https://scholar.googleusercontent.com/scholar?q=cache:FQ81FPrTiQAJ:scholar.google.com/+bluetooth-disconnection+events&hl=en&as_sdt=1,47)(2009).*

International Search Report for related PCT Application No. PCT/GB2013/052021 dated Jan. 3, 2014.

Search Report under Section 17 for related GB Application No. 1213291.6 dated Dec. 19, 2012.

Doukas et al., "Intelligent Pervasive Healthcare Systems," Studies in Computational Intelligence (SCI) 107, 95-115, 2008, Springer-Verlag, Berlin Heidelberg 2008.

* cited by examiner

DRIVING BEHAVIOR MONITORING SYSTEM

CROSS-REFERENCE TO RELATED APPLICATIONS

This application is a continuation of U.S. patent application Ser. No. 14/417,282, filed 26 Jan. 2015, and published as U.S. Patent Publication No. US2015/0213656 on 30 Jul. 2015. U.S. patent application Ser. No. 14/417,282 is a U.S. National Stage Application of International Application No. PCT/GB2013/052021, filed 26 Jul. 2013, which claims the benefit of GB Application No. 1213291.6, filed 26 Jul. 2012, each of which are fully incorporated by reference herein as if presented in full.

The present invention relates to a driving behaviour monitoring system.

It can be desirable to monitor how a vehicle is used in order to be able to use the vehicle usage data for a supplementary purpose. One use of such vehicle usage data is to be able to calculate, or adjust, a vehicle insurance premium in dependence upon how the vehicle is being used. Another use of such vehicle usage data would be to provide feedback to the driver on how they are driving, for example, how safely they are driving.

According to a first aspect of the invention there is provided a driving behaviour monitoring system comprising an on-board diagnostics module adapted to be mounted in a vehicle, the on-board diagnostics module comprising a vehicle usage monitor operative to monitor usage of the vehicle and to generate vehicle usage data based on at least one usage characteristic of the vehicle, the system further comprising a controller and a driving behaviour scoring server arranged to be in real-time communication with the controller via a telecommunications network, the on-board diagnostics module further comprising a transceiver operative to transmit the vehicle usage data to the server via the controller, the server comprising a database on which vehicle usage data is stored, the server further comprising a data processor controlled by an algorithm such that the server is operative to generate an alert signal by processing the vehicle usage data generated by the on-board diagnostics module and the road usage data stored on the database, the alert signal being indicative of a driving behaviour score.

Preferably the server is operative to transmit the alert signal from the server to the controller for review by the driver. The server and controller may be arranged such that the alert signal is transmitted to the controller such that the driver can review the driving score in real-time.

In one example, the on-board diagnostics module comprises a wireless transceiver operative to transmit and/or receive data from the controller wirelessly, the controller being provided on a separate mobile telecommunications device, such as a Smartphone for example. The wireless transceiver may comprise a Bluetooth® unit.

In another example, the on-board diagnostics module and controller are integral, the transceiver of the on-board diagnostics module comprising a mobile telecommunications transceiver operative to enable communication between the controller and the server via a mobile telecommunications network.

Preferably the on-board diagnostics module comprises a micro processor, a PCB, a flash memory, and a tri-axial accelerometer.

The on-board diagnostics module may be powered by its own internal battery, or comprise a suitable electrical connection to receive power from the vehicle.

The on-board diagnostics module may comprise an interface operative to connect with, and receive data from, the vehicle's European On Board Diagnostics (EOBD) port.

Preferably the on-board diagnostics module is operative to process a time signal and to obtain vehicle usage data at periodic time intervals, the on-board diagnostics module being operative to use the time signal to time stamp the vehicle usage data, and to send time stamped data packets of vehicle usage data to the controller.

The on-board diagnostics module may comprise a clock operative to generate its own time signal, or may receive a time signal generated from a clock on the controller or the server.

Preferably the on-board diagnostics module is operative to obtain vehicle usage data selected from one, some or all of the following vehicle usage characteristics:

a) Vehicle ignition-on and ignition-off events; and/or b) Bluetooth device connection and disconnection events to/from EOBD port; and/or c) Bluetooth power on and off events; and/or d) Accelerometer data in three axes x, y and z; or and/or e) Other data available from the appropriate vehicle management system.

The controller may comprise software or hardware on the mobile telecommunications device or the onboard diagnostics module, as appropriate. The controller may comprise a software application downloaded onto the mobile telecommunications device or the onboard diagnostics module.

The controller may also receive positional information from a GPS unit, the controller being operative to combine the positional information with the vehicle usage information from the on-board diagnostics module to form an aggregated vehicle usage data which is transmitted to the server.

The GPS unit may comprise a GPS unit on the mobile telecommunications device, or may comprise a GPS unit provided on the onboard diagnostics module.

Preferably the database on the server comprises data indicative of the road speed limit, the algorithm processing the vehicle usage data and the road speed limit data to generate the driving behaviour score.

The system may be capable of transmitting vehicle fault identifiers (to assist recovery services in the case of a breakdown) from the onboard diagnostics module.

According to a second aspect of the invention there is provided an on-board vehicle usage diagnostics module for use with a driving behaviour monitoring system, the on-board diagnostics module adapted to be mounted in a vehicle, and a vehicle usage monitor operative to monitor usage of the vehicle and to generate vehicle usage data based on at least one usage characteristic of the vehicle, the on-board diagnostics module further comprising a transceiver operative to transmit the vehicle usage data to a driving behaviour scoring server of the driver behaviour monitoring system via a controller, the controller and a server being arranged to be in real-time communication with the controller via a telecommunications network, the server comprising a database on which road usage data is stored, the server further comprising a data processor controlled by an algorithm such that the server is operative to generate an alert signal from processing the vehicle usage data generated by the on-board diagnostics module and from the vehicle usage data stored on the database, the alert signal being indicative of a driving behaviour score.

According to a third aspect of the invention there is provided a method of monitoring driving behaviour comprising steps of:

using an on-board diagnostics module adapted to be mounted in a vehicle to monitor usage of the vehicle;

generating vehicle usage data based on at least one usage characteristic of the vehicle, transmitting the vehicle usage data to a driving behaviour scoring server in real-time communication via a telecommunications network;

providing a database on which road usage data is stored;

controlling the server by an algorithm such that the server is operative generate an alert signal from processing the vehicle usage data generated by the on-board diagnostics module and from the vehicle usage data stored on the database, the alert signal being indicative of a driving behaviour score.

Other aspects of the present invention may include any combination of the features or limitations referred to herein.

Figure 2:
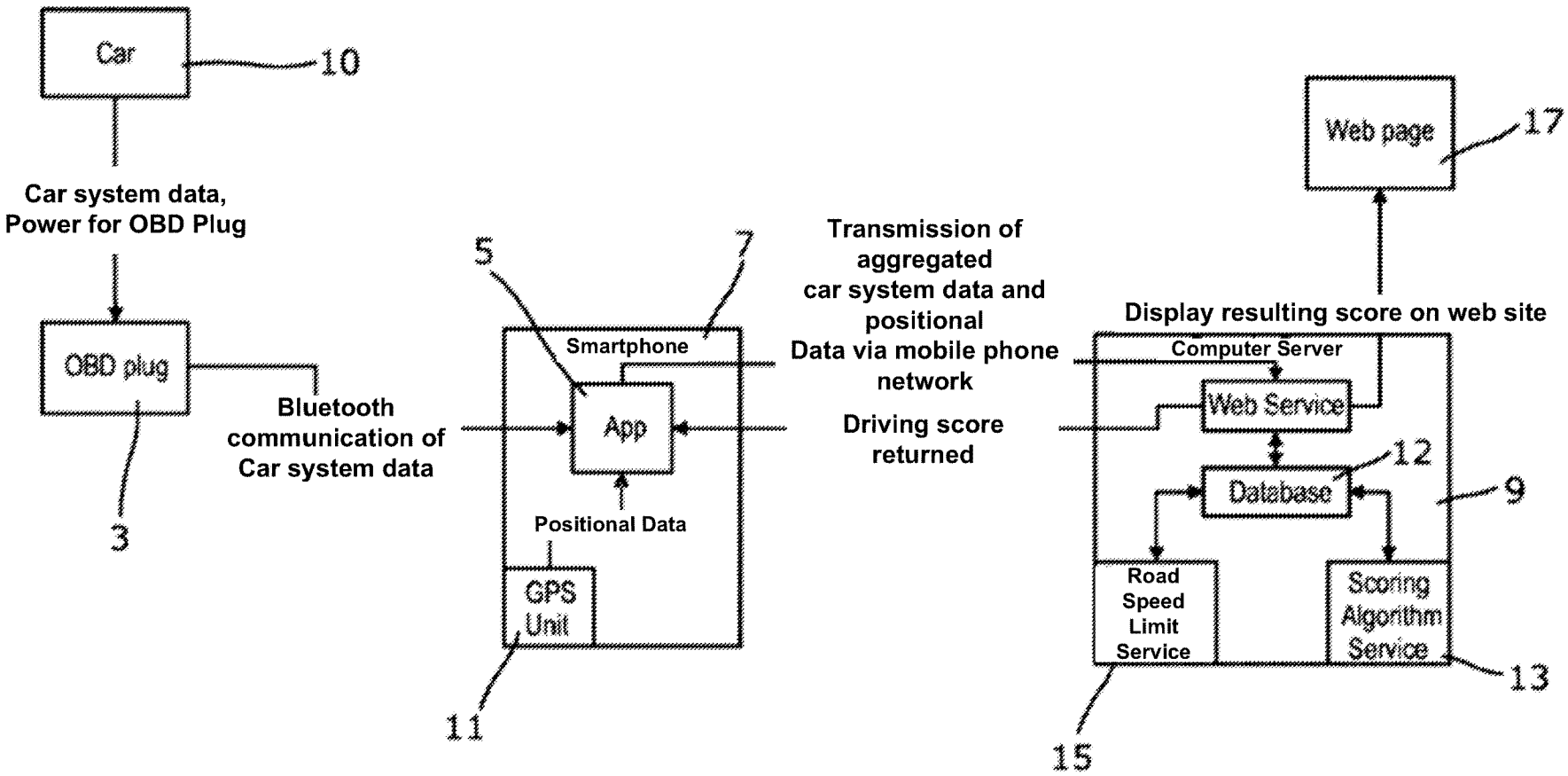

The present invention may be carried into practice in various ways, but embodiments will now be described by way of example only with reference to the accompanying drawings in which:

FIG. 1 is a schematic view of a driving behaviour monitoring system in accordance with the present invention; and FIG. 2 is a control diagram of the system of FIG. 1.

A driving behaviour monitoring system 1 comprises an on-board diagnostics module 3, a controller 5, which in this example is in the form of a software application downloaded onto a mobile telecommunications device 7, and a server 9. The module 3 is provided with a wireless data transceiver such as a Bluetooth® unit which wirelessly transmits vehicle usage data to the controller 5. The controller 5 transmits the vehicle usage data, optionally along with vehicle positional data obtained from a GPS unit 11 on the device 7 to the server 9 via a standard mobile telecommunications network as encrypted data. On-board diagnostics module 3 is adapted to be mounted on a vehicle 10 such that the on-board diagnostics module 3 cannot move relative to the vehicle 10, that is, so that the movement and forces of the vehicle 10 equal those of the on-board diagnostics module 3. The vehicle 10 may be provided with a suitable socket into which the on-board diagnostics module 3 can be inserted and retained.

The server 9 is operated remotely and comprises a database 12 on which vehicle usage data is stored, and from which a driving behaviour score is calculated, stored, and transmitted back to the controller and/or optionally to a linked website. The driving behaviour score is calculated by a software algorithm 13 on the server from the vehicle usage data generated by the on-board diagnostics module 3, the vehicle positional data if any, the vehicle usage data stored on the database 12, and optionally also from road speed limit data obtained from a road speed limit service 15.

The algorithm 13 is operative to generate an alert signal a score which rates the driving behaviour of the driver of the vehicle 10, in real-time, on a predetermined scoring system stored on the database 12. That algorithm 13 may reference other vehicle usage data prestored on the database 12 such as earlier scores of the driver in question, earlier scores for the vehicle in question, and any other desired data such as relating to manufacturer's stated vehicle performance, and the age of the vehicle for example. The score may be generated so as to provide the driver with an indicator of a driving or vehicle characteristic. That characteristic might be how safely the driver is driving, or how fuel economically the driver is driving.

The signal indicative of the driving behaviour score is transmitted from the server 9 to the controller 5 in real-time, via the mobile telecommunications network. The controller 5 may be operative to store the score for later review or may be operative to instantaneously display the score on the display of the mobile device 7, or an associated display of the onboard diagnostics module 3. The score may also be transmitted from the server 9 to a remote webpage 17 for later review either by the vehicle driver, or an external agency such as an insurance provider.

Preferably the controller 5 comprises a Smartphone software application downloaded onto the Smartphone 7, and the on-board diagnostics module 3 comprises a Bluetooth® slave device that wirelessly transmits data to the controller 5, that is, to the Smartphone 7.

The Smartphone application 5 is downloaded onto the driver's Smartphone 7. It is securely paired to the Bluetooth transceiver of on-board diagnostics module 3 using a unique code. The on-board diagnostics module 3 may also comprise an interface that enables the on-board diagnostics module 3 to receive data from the vehicle's European On Board Diagnostic's (EOBD) port.

Once the Smartphone 7 detects the Bluetooth on-board diagnostics module 3, the Smartphone application 5 may automatically start to record data, or may prompt the vehicle driver to allow the module 3 to begin recording data. The data recorded can include one, some or all of the following vehicle usage characteristics as time stamped events, time stamped at a periodic frequency as required:

a) Latitude
b) Longitude
c) Heading direction
d) Velocity
e) Attitude
f) Horizontal GPS accuracy
g) Vertical GPS accuracy The on-board diagnostics module 3 comprises a Bluetooth® transceiver unit, a micro-processor, a printed circuit board, a flash-memory and may also comprise an EOBD interface, tri-axial accelerometer and/or an internal battery. The on-board diagnostics module 3 is operative to send periodic packets of time stamped vehicle usage data to the controller 5 indicative of one, some or all of the following vehicle usage characteristics:

Vehicle ignition-on and ignition-off events

Bluetooth® device connection and disconnection events to/from EOBD port

Bluetooth® power on and off events

Accelerometer data in three axes: x, y and z.

Other such data available from the appropriate vehicle management system.

The controller 5 receives data wirelessly from the on-board diagnostics module 3 and aggregates this data to any vehicle positional data as may be recorded via the GPS unit 11 on the Smartphone. The Smartphone 7 transmits all (aggregated) vehicle usage data to the database 12 via machine-to-machine communication at a parameterised data recording frequency, using the mobile telecommunications network. The database 12 then generates a signal indicative of a driving behaviour score calculated inside the server 9 in real-time. The driving behaviour score may or may not be displayed via the Smartphone 7 to the driver, also in real-time.

By real-time, we mean as close as is possible to instantaneous, allowing for latency in data transmission time from the on-board diagnostics module 3 to the controller 5, from the controller 5 to the server 9, and vice versa, and also allowing for any processing time taken by the algorithm in the server 9. It is intended that the driver behaviour score be transmitted sufficiently quickly that the driver can modify his behaviour at that time, rather than waiting until after he has finished driving.

In relation to initiation of the communication link between the controller and the transceiver, this is achieved by way of the transceiver detecting when the controller is in range. This could be achieved by way of the transceiver issuing polling signals to determine whether the controller is in the vehicle. By arranging that the transceiver initiates the communication link, this ensures more efficient use of battery resource available for the controller. Otherwise, the controller would issue polling signals unnecessarily when it was not in the vehicle. In this manner, the transceiver serves as the master and the controller as the slave. Moreover, in the event that the controller is detected by the transceiver to be in range of the controller, but is not in the vehicle, the transceiver can look at other data, such as the RPM of the vehicle, and can determine whether data should be transmitted to the controller. If it is determined that the RPM is zero, the transceiver can determine that the vehicle is stationary and so no data needs to be transmitted to the controller.

The use of the slave on-board diagnostics module 3 removes the need for the Smartphone 9 to be affixed immovably to the vehicle, and thus alleviates any inaccuracy in accelerometer readings that might otherwise occur from the Smartphone 9 moving in use. The on-board diagnostics module 3 is adapted to be permanently or removably fixed to the vehicle, using any suitable form of bracket, fixing or plug-socket arrangement. The module may be embodied as a "bolt-on" or retro-fit component.

In an alternative embodiment, the onboard diagnostics module 3 is provided with the controller 5, the transceiver being a mobile telecommunication device transceiver operative to communicate with the mobile telecommunications network, and therefore the server 9, directly, without a mobile telephone 7 as an intermediary. In this instance the onboard diagnostics module 3 may comprise its own SIM and SIM card, and any other component of a mobile telephone as may be required.

What is claimed is:

1. A system comprising:

a controller configured for communication with a driving behavior scoring server via a telecommunications network;

an on-board diagnostic module adapted to be mounted in a vehicle, the on-board diagnostic module comprising:

an accelerometer;

a vehicle usage monitor operative to monitor usage of the vehicle and to generate vehicle usage data based on at least one usage characteristic of the vehicle;

a transceiver comprising an on-board diagnostic port device, wherein the transceiver is configured to:

determine vehicle usage data for transmission to the controller, wherein the vehicle usage data includes accelerometer data, vehicle ignition-on and ignition-off event data, associated positional information, and one or more of horizontal and vertical GPS accuracy information;

aggregate the vehicle usage data;

periodically transmit packets of the aggregated vehicle usage data to the driving behavior scoring server via the controller; and receive, from the driving behavior scoring server, feedback based on the vehicle usage data.

2. The system of claim 1; wherein the driving behavior scoring server and the controller are configured to be in real-time communication via the telecommunications network.

3. The system of claim 1, wherein the on-board diagnostic port device of the transceiver is retrofittable.

4. The system of claim 1, wherein the on-board diagnostic module comprises a wireless transceiver operative to transmit and/or receive data from the controller wirelessly, the controller being provided on a separate mobile telecommunications device.

5. The system of claim 1, wherein the on-board diagnostic module and controller are integral, and wherein the transceiver of the on-board diagnostic module comprises a mobile telecommunications transceiver operative to enable communication between the controller and the server via a mobile telecommunications network.

6. The system of claim 1, wherein the on-board diagnostic module further comprises a microprocessor, a PCB, a flash memory, and a tri-axial accelerometer.

7. The system of claim 1, wherein the on-board diagnostic module is configured to detect and receive power from the vehicle.

8. The system of claim 1, wherein the on-board diagnostic module further comprises an interface operative to connect with and receive data from the vehicle's on-board diagnostic port.

9. The system of claim 1, wherein the on-board diagnostic module is configured to process a time signal and to obtain vehicle usage data at periodic time intervals, the on-board diagnostic module further configured to time stamp the vehicle usage data based on the processed time signal, and to send time stamped data packets of vehicle usage data to the controller.

10. The system of claim 9, wherein the on-board diagnostic module comprises a clock operative to generate the time signal.

11. The system of claim 9, wherein the on-board diagnostic module is configured to receive a time signal generated from a clock on one or more of the controller and the driving behavior scoring server.

12. The system of claim 1, wherein the on-board diagnostic module is operative to obtain vehicle usage data comprising one or more of:

wireless device connection events;

wireless device disconnection events; and one or more wireless device power transition events;

wherein the one or more vehicle power transition events comprise one or more of a vehicle ignition-on event and a vehicle ignition-off event.

13. The system of claim 1, wherein the driving behavior scoring server comprises:

a database on which vehicle usage data and road usage data is stored; and a data processor operative to generate a driving behavior score by processing the vehicle usage data and the road usage data.

14. The system of claim 1, wherein the transceiver is further operative to issue polling signals to determine whether the controller is in the vehicle.

15. The system of claim 1, wherein the controller comprises a software application downloaded to one or more of a mobile telecommunications device and the on-board diagnostic module.

16. The system of claim 1, wherein the driving behavior scoring server is configured to store road usage data indicative of a road speed limit, wherein the vehicle usage data and the road usage data are processed to generate the driving behavior score.

17. A method comprising:

receiving, by a transceiver in communication with an on-board diagnostic port, accelerometer data using an on-board diagnostic module, the on-board diagnostic module adapted to be mounted in a vehicle to monitor usage of the vehicle;

generating vehicle usage data, the vehicle usage data including the accelerometer data, vehicle ignition-on and ignition-off event data, and one or more of horizontal and vertical GPS accuracy information;

aggregating the vehicle usage data;

periodically transmitting, to a driving behavior scoring server via a telecommunications network, time-stamped packets of the aggregated vehicle usage data;

receiving, from the driving behavior scoring server, feedback based on the vehicle usage data; and displaying an indication of the feedback.

18. The method of claim 17, further comprising:

issuing, by the transceiver, polling signals to a controller; and determining whether the controller is in the vehicle.

19. The system of claim 12, wherein one or more of the wireless device connection or disconnection events comprise Bluetooth connection or disconnection events.

20. The method of claim 17, wherein the vehicle usage data further comprising one or more of wireless device connection events and wireless device disconnection events.

* * * * *